US012723786B2

(12) United States Patent
Kikutake et al.

(10) Patent No.: US 12,723,786 B2
(45) Date of Patent: Sep. 1, 2026

(54) COMPRESSOR UNIT AND REFRIGERATION APPARATUS

(71) Applicant: DAIKIN INDUSTRIES, LTD., Osaka (JP)

(72) Inventors: Daiki Kikutake, Osaka (JP); Tatsuya Katayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/615,823

(22) Filed: Mar. 25, 2024

(65) Prior Publication Data

US 2024/0230175 A1 Jul. 11, 2024

Related U.S. Application Data

(63) Continuation of application No. PCT/JP2022/027885, filed on Jul. 15, 2022.

(30) Foreign Application Priority Data

Sep. 30, 2021 (JP) ..... 2021-161447
Dec. 15, 2021 (JP) ..... 2021-203179

(51) Int. Cl.
*F25B 31/02* (2006.01)
*F04C 18/348* (2006.01)

(52) U.S. Cl.
CPC ..... *F25B 31/026* (2013.01); *F04C 18/348* (2013.01); *F04C 2240/807* (2013.01)

(58) Field of Classification Search
CPC ..... F04B 39/00; F04B 39/12; F04C 29/00; F04C 29/12; H02K 7/14; H02K 15/16
USPC ..... 418/173
See application file for complete search history.

(56) References Cited

FOREIGN PATENT DOCUMENTS

| | | | | |
|---|---|---|---|---|
| EP | 2628950 | A1 * | 8/2013 | ..... F04C 28/28 |
| EP | 2 685 106 | A2 | 1/2014 | |
| EP | 4390133 | A1 * | 6/2024 | ..... F04B 39/00 |
| JP | 62-16776 | U | 1/1987 | |
| JP | 5-99177 | A | 4/1993 | |
| JP | 2004-60605 | A | 2/2004 | |
| JP | 2004-239099 | A | 8/2004 | |

(Continued)

OTHER PUBLICATIONS

International Preliminary Report of corresponding PCT Application No. PCT/JP2022/027885 dated Apr. 11, 2024.

(Continued)

*Primary Examiner* — J. T. Newton
(74) *Attorney, Agent, or Firm* — Spencer Fane LLP

(57) ABSTRACT

A compressor unit includes a compressor body with a compression mechanism, and an accumulator. The compression mechanism includes a cylinder, a piston, and a blade. $F\times(h/I)\times L\leq 19\times P+128$. F represents a value obtained by multiplying a weight of the piston and the blade by a square of the number of revolutions of the compressor body, and h represents a distance from a center of the piston in a thickness direction to a center of gravity of the compressor unit. I represents a moment of inertia around a center axis of the compressor unit passing through the center of gravity of the compressor unit. L represents a distance from an axis of an inlet pipe of the accumulator to the center of gravity of the compressor unit, and P represents a refrigeration apparatus rated capacity.

19 Claims, 12 Drawing Sheets

(56) References Cited

FOREIGN PATENT DOCUMENTS

| | | | | |
|---|---|---|---|---|
| JP | 2011-185123 | A | 9/2011 | |
| JP | 2014-20209 | A | 2/2014 | |
| JP | 2014-92078 | A | 5/2014 | |
| WO | WO-2018168345 | A1 * | 9/2018 | ..... F04C 29/12 |

OTHER PUBLICATIONS

International Search Report of corresponding PCT Application No. PCT/JP2022/027885 dated Sep. 27, 2022.
European Search Report of corresponding EP Application No. 22 87 5550.0.3 dated Nov. 15, 2024.

* cited by examiner

FIG.10
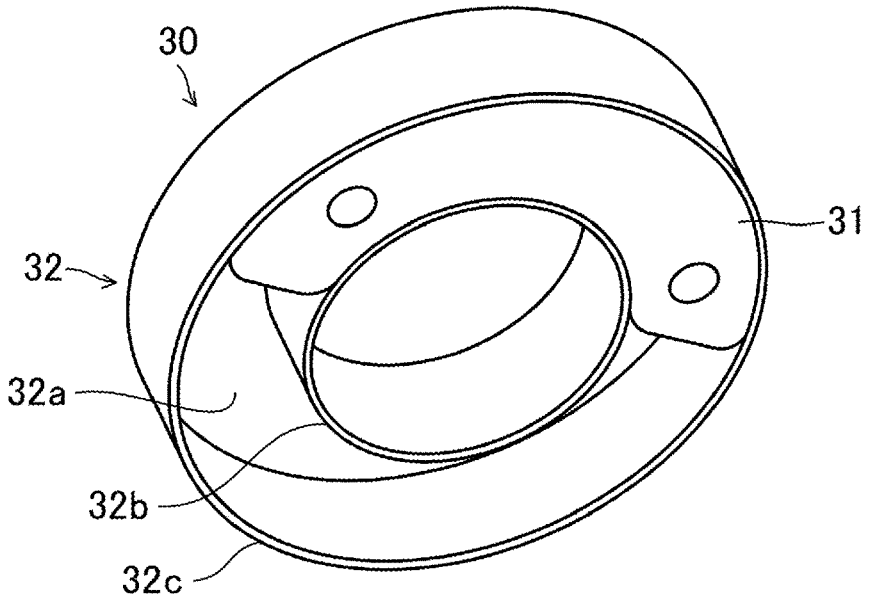
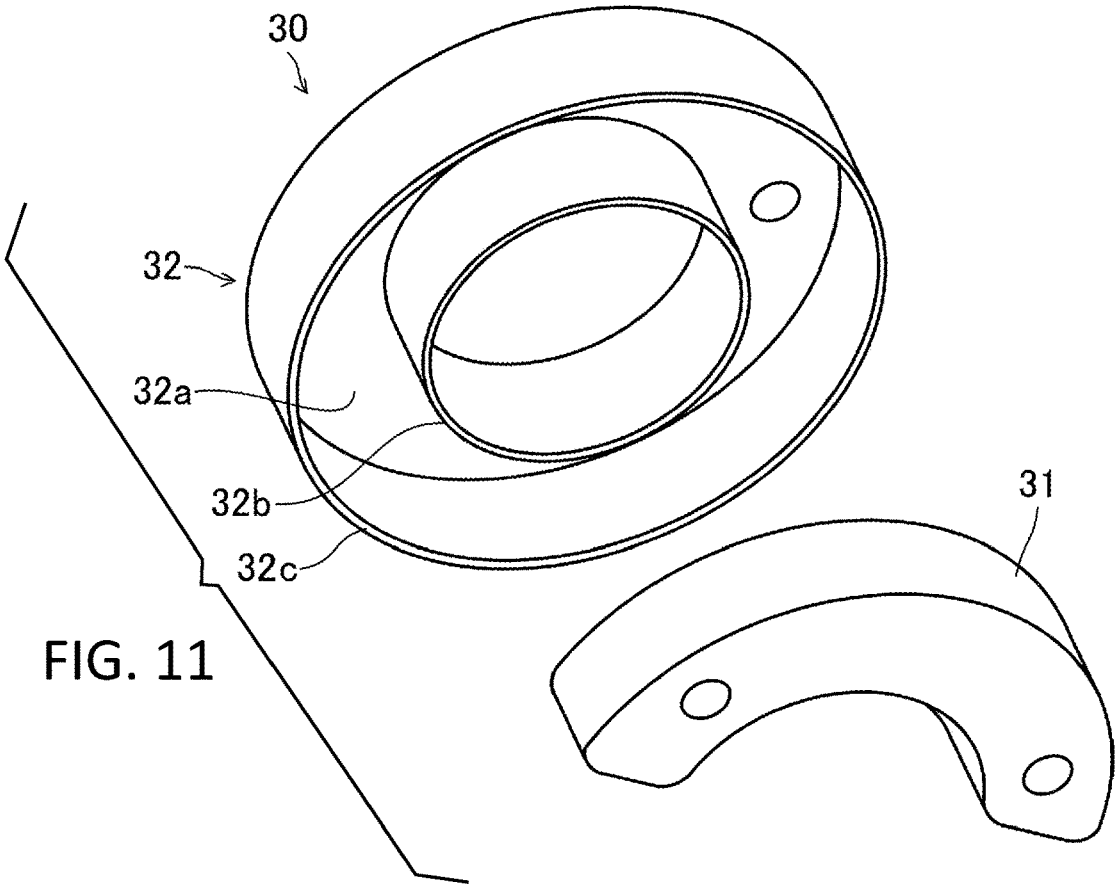
FIG. 11

COMPRESSOR UNIT AND REFRIGERATION APPARATUS

CROSS-REFERENCE TO RELATED APPLICATIONS

This is a continuation of International Application No. PCT/JP2022/027885 filed on Jul. 15, 2022, which claims priority to Japanese Patent Application Nos. 2021-161447, filed on Sep. 30, 2021 and 2021-203179m filed on Dec. 15, 2021. The entire disclosures of these applications are incorporated by reference herein.

BACKGROUND

Technical Field

The present disclosure relates to a compressor unit and a refrigeration apparatus.

Background Art

Japanese Unexamined Patent Publication No. 2011-185123 discloses a compressor unit including a compressor body and an accumulator connected to the compressor body.

According to the invention of Japanese Unexamined Patent Publication No. 2011-185123, the connecting portion of the inlet pipe of the accumulator is located close to the center of support of the compressor body, thereby reducing the propagation, to the inlet pipe, of vibrations in the direction of inclination of the compressor body and vibrations in the axial direction of the compressor body during operation of the compressor body.

SUMMARY

A first aspect of the present disclosure is directed to a compressor unit for use in a refrigeration apparatus configured to perform a refrigeration cycle. The compressor unit includes a compressor body including a compression mechanism, and an accumulator connected to the compressor body. The compression mechanism includes a cylinder, a piston configured to rotate eccentrically in the cylinder, and a blade partitioning an interior of a compression chamber of the cylinder into a low-pressure chamber and a high-pressure chamber. $F\times(h/I)\times L\leq 19\times P+128$. F represents a value obtained by multiplying a weight of the piston and the blade by a square of the number of revolutions of the compressor body, and h represents a distance from a center of the piston in a thickness direction to a center of gravity of the compressor unit. I represents a moment of inertia around a center axis of the compressor unit passing through the center of gravity of the compressor unit, which is also a center of rotation of the compressor body during vibrations in a direction in which the compressor body inclines toward the accumulator. L represents a distance from an axis of an inlet pipe of the accumulator to the center of gravity of the compressor unit, and P represents a rated capacity of the refrigeration apparatus.

BRIEF DESCRIPTION OF THE DRAWINGS

FIG. 10 is a perspective view illustrating a configuration of a balance weight according to a first variation.

FIG. 11 is an exploded perspective view illustrating the configuration of the balance weight.

DETAILED DESCRIPTION OF EMBODIMENT(S)

Embodiments

Figure 1:
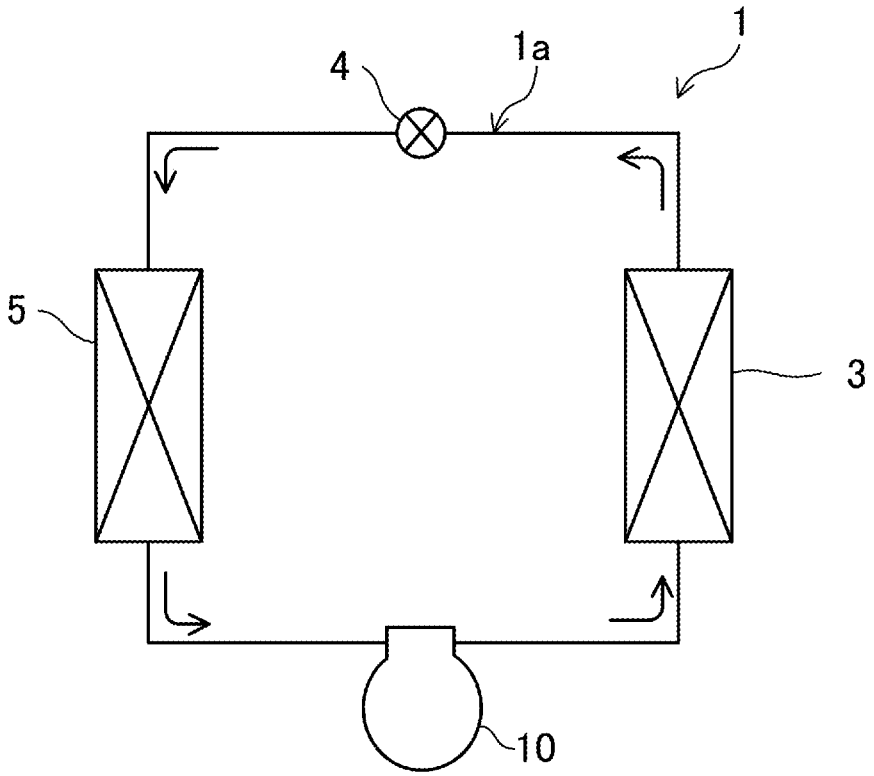
FIG. 1 is a refrigerant circuit diagram showing a configuration of a refrigeration apparatus according to an embodiment.

As illustrated in FIG. 1, a compressor unit (10) is provided in a refrigeration apparatus (1). The refrigeration apparatus (1) includes a refrigerant circuit (la) filled with a refrigerant. The refrigerant circuit (1*a*) includes a compressor unit (10), a radiator (3), a decompression mechanism (4), and an evaporator (5). The decompression mechanism (4) is, for example, an expansion valve. The refrigerant circuit (1*a*) performs a vapor compression refrigeration cycle.

In the refrigeration cycle, the refrigerant compressed by the compressor unit (10) dissipates heat to the air in the radiator (3). The refrigerant which has dissipated heat is decompressed by the decompression mechanism (4) and evaporates in the evaporator (5). The evaporated refrigerant is sucked into the compressor unit (10).

The refrigeration apparatus (1) is an air conditioner. The air conditioner may be any of a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (1) may be a water heater, a chiller unit, or a cooling apparatus configured to cool air in an internal space. The cooling apparatus cools the air in an internal space of a refrigerator, a freezer, a container, or the like.

Figure 2:
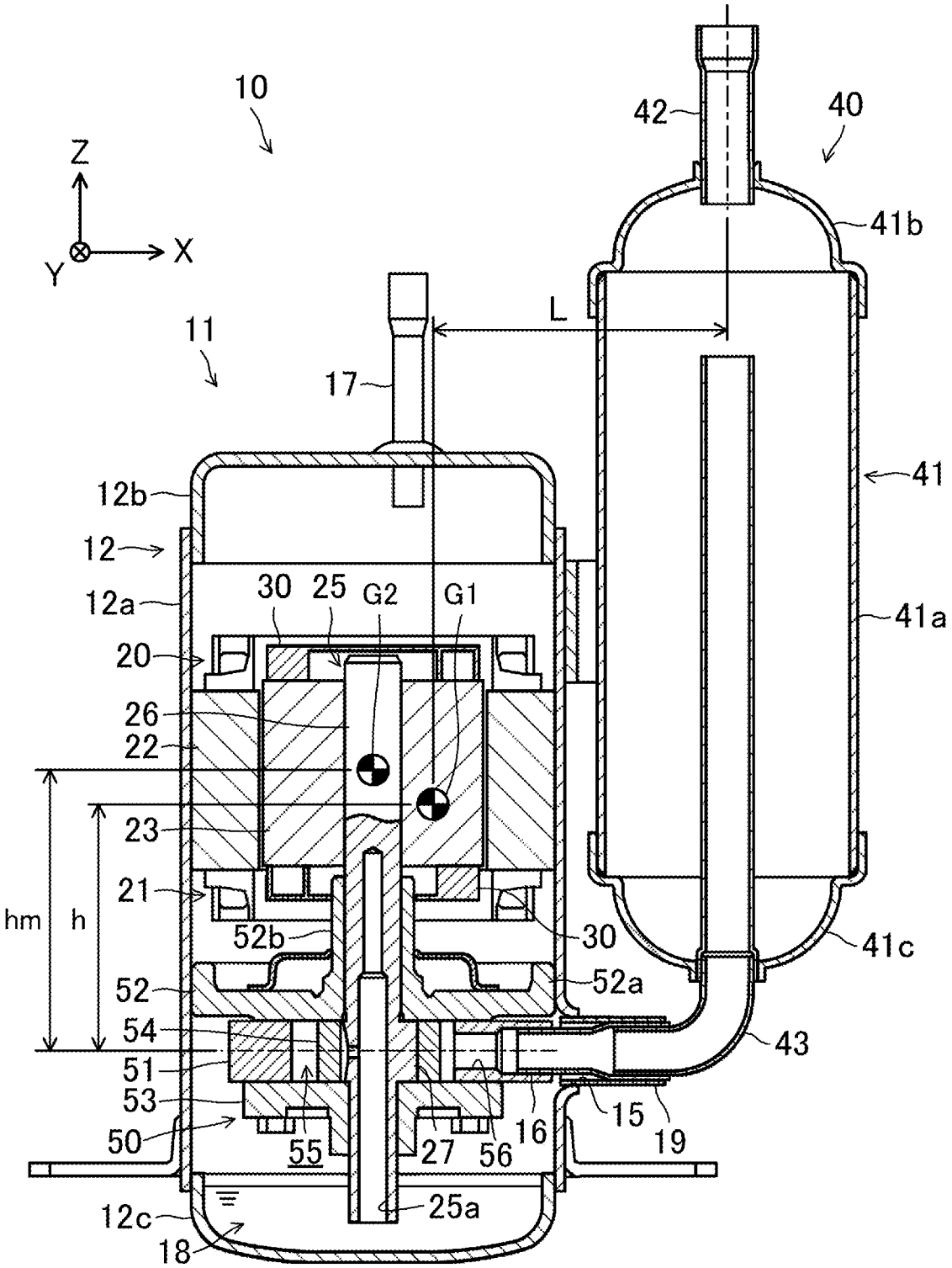
FIG. 2 is a longitudinal sectional view illustrating a configuration of a compressor unit.

As illustrated in FIG. 2, the compressor unit (10) includes a compressor body (11) and an accumulator (40). The accumulator (40) is connected to the compressor body (11). The compressor body (11) includes a casing (12), a drive mechanism (20), and a compression mechanism (50).

In FIG. 2, the lateral direction in which the compressor body (11) and the accumulator (40) are arranged will be referred to as the "X-axis direction," the depth direction of the sheet orthogonal to the X-axis direction as the "Y-axis direction," and the vertical direction along which the compressor body (11) stands as the "Z-axis direction."

The casing (12) is configured as a vertically long cylindrical closed container. The casing (12) includes a barrel (12*a*), an upper cup (12*b*), and a lower cup (12*c*). The barrel (12*a*) is in the shape of a cylinder extending in the vertical direction, with both axial ends open. The upper cup (12*b*) is fixed to the upper end of the barrel (12*a*) to close the upper opening of the barrel (12*a*). The lower cup (12*c*) is fixed to the lower end of the barrel (12*a*) to close the lower opening of the barrel (12*a*). A suction pipe (16) passes through, and is fixed to, the barrel (12*a*). A discharge pipe (17) passes through, and is fixed to, the upper cup (12*b*).

The casing (12) has, at its bottom, an oil reservoir (18). The oil reservoir (18) is formed by the inner wall of a lower portion of the barrel (12*a*) and the lower cup (12*c*). The oil reservoir (18) stores a lubricant. The lubricant lubricates sliding portions of the compression mechanism (50) and a drive shaft (25).

The drive mechanism (20) is housed in the casing (12). The drive mechanism (20) includes a motor (21), the drive shaft (25), and balance weights (30). The motor (21) is disposed above the compression mechanism (50). The motor (21) includes a stator (22) and a rotor (23).

The stator (22) is fixed to the inner peripheral surface of the barrel (12*a*) of the casing (12). The rotor (23) passes through the stator (22) in the vertical direction. The drive shaft (25) is placed in the axis of the rotor (23) and fixed thereto. The drive shaft (25) is driven to rotate together with the rotor (23) when the motor (21) is energized.

The drive shaft (25) is located on the axis of the barrel (12*a*) of the casing (12). An oil supply passage (25*a*) is formed inside the drive shaft (25). The lower end of the drive shaft (25) is immersed in the oil reservoir (18). The lubricant stored in the oil reservoir (18) is supplied to the sliding portions of the compression mechanism (50) and the drive shaft (25) through the oil supply passage (25*a*) inside the drive shaft (25).

The drive shaft (25) has a main shaft portion (26) and an eccentric portion (27). An upper portion of the main shaft portion (26) is fixed to the rotor (23) of the motor (21). The eccentric portion (27) has an axis decentered by a predetermined distance with respect to the axis of the main shaft portion (26).

A portion of the main shaft portion (26) above the eccentric portion (27) is rotatably supported by a boss portion (52*b*) of a front head (52) to be described later. A portion of the main shaft portion (26) below the eccentric portion (27) is rotatably supported by a rear head (53) to be described later.

The balance weights (30) are provided at both axial ends of the rotor (23). Each of the balance weights (30) has a ring-shaped weight body (31) extending in a circumferential direction. A surface of the weight body (31) near the rotor (23) has a recess (31*a*) extending along the circumferential direction (see FIG. 3).

The compression mechanism (50) is housed in the casing (12). The compression mechanism (50) is disposed below the motor (21). The compression mechanism (50) includes a cylinder (51), the front head (52), the rear head (53), a piston (54), and a blade (57).

The cylinder (51) is configured as a flat and substantially annular member. The cylinder (51) has a circular compression chamber (55) at its center. The cylinder (51) has a suction passage (56) extending in a radial direction. The downstream end of the suction passage (56) communicates with the compression chamber (55). The suction pipe (16) is connected to the upstream end of the suction passage (56).

The barrel (12*a*) of the casing (12) has a through hole (15) at a position facing the suction passage (56). A joint pipe (19) is connected to the through hole (15) of the casing (12). The joint pipe (19) is made of a cylindrical member made of a metal material. The joint pipe (19) is joined to the barrel (12*a*) of the casing (12) while being fitted in the through hole (15). The joint pipe (19) extends from the barrel (12*a*) of the casing (12) toward the outside of the casing (12).

The suction pipe (16) is connected to the suction passage (56) of the cylinder (51) and extends through the inside of the joint pipe (19) to the outside of the casing (12). The outer peripheral surface of the suction pipe (16) is brazed to the inner peripheral surface of the joint pipe (19).

The front head (52) is disposed on an upper portion of the cylinder (51). The front head (52) covers the internal space of the cylinder (51) from above. The front head (52) includes an annular plate portion (52*a*) and the boss portion (52*b*).

The annular plate portion (52*a*) is made of a flat annular member and is stacked on an upper end portion of the cylinder (51). The annular plate portion (52*a*) is fixed to the inner peripheral surface of the barrel (12*a*) of the casing (12). The boss portion (52*b*) is made of a tubular member extending upward from a radially central portion of the annular plate portion (52*a*). The boss portion (52*b*) rotatably supports the main shaft portion (26) of the drive shaft (25). The front head (52) has a discharge passage (not shown) passing through the annular plate portion (52*a*) in the axial direction.

The rear head (53) is disposed on a lower portion of the cylinder (51). The rear head (53) covers the internal space of the cylinder (51) from below. The rear head (53) rotatably supports the main shaft portion (26) of the drive shaft (25).

Figure 4:
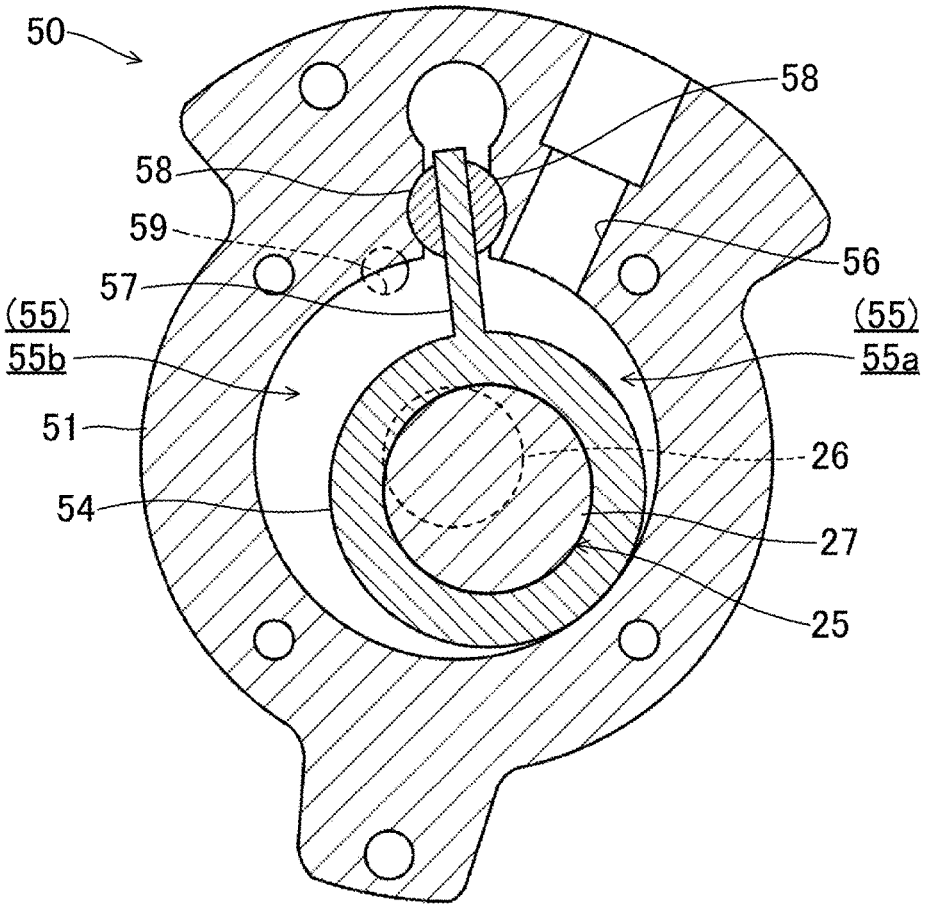
FIG. 4 is a plan sectional view illustrating a configuration of a compression mechanism.

As illustrated also in FIG. 4, the piston (54) is housed in the cylinder (51). The blade (57) is integrated with the piston (54). The compression chamber (55) is defined by the cylinder (51) and the piston (54). The piston (54) has a perfect circular annular shape. The eccentric portion (27) of the drive shaft (25) is fitted in the piston (54). The interior of the compression chamber (55) is partitioned into a low-pressure chamber (55*a*) and a high-pressure chamber (55*b*) by the blade (57). The blade (57) is supported by a pair of bushes (58), which allow oscillation of the blade (57).

The piston (54) rotates eccentrically in the cylinder (51) when the drive shaft (25) is driven to rotate. The refrigerant flowing through the suction pipe (16) is sucked into the low-pressure chamber (55*a*) through the suction passage (56) as the volume of the low-pressure chamber (55*a*) is gradually increased by the eccentric rotation of the piston (54).

Next, the low-pressure chamber (55*a*) is isolated from the suction passage (56), and the isolated space forms the high-pressure chamber (55*b*). The internal pressure of the high-pressure chamber (55*b*) increases as the volume of the high-pressure chamber (55*b*) gradually decreases. When the internal pressure of the high-pressure chamber (55*b*) exceeds a predetermined pressure, the refrigerant in the high-pressure chamber (55*b*) flows out of the compression mechanism (50) through a discharge passage (59). This high-pressure refrigerant flows upward in the internal space of the casing (12) and passes through core cuts (not shown) or other portions of the motor (21). The high-pressure refrigerant that has flowed upward of the motor (21) is transferred to the refrigerant circuit through the discharge pipe (17).

Configuration of Accumulator

The accumulator (40) is connected to the upstream side of the compressor body (11). The accumulator (40) temporarily stores the refrigerant before suction into the compressor body (11) and provides gas-liquid separation of a liquid refrigerant and refrigerating machine oil which are contained in a refrigerant gas.

The accumulator (40) includes a container body (41), an inlet pipe (42), and an outlet pipe (43). The inlet pipe (42) allows the refrigerant to flow into the container body (41). The outlet pipe (43) allows the refrigerant to flow out of the container body (41).

The container body (41) is configured as a vertically long cylindrical member. The container body (41) includes a barrel (41*a*), an upper housing (41*b*), and a lower housing (41*c*). The barrel (41*a*) is in the shape of a cylinder extending in the vertical direction with both axial ends open. The upper housing (41*b*) is fixed to the upper end of the barrel (41*a*) to close the upper opening of the barrel (41*a*). The lower housing (41*c*) is fixed to the lower end of the barrel (41*a*) to close the lower opening of the barrel (41*a*).

The inlet pipe (42) is connected to an upper portion of the upper housing (41*b*). A lower end portion of the inlet pipe (42) is open near an upper portion of the internal space of the container body (41). The outlet pipe (43) is connected to a lower portion of the lower housing (41*c*). An upper end portion of the outlet pipe (43) extends upward in the container body (41) and is open near the upper portion of the internal space of the container body (41).

A lower end portion of the outlet pipe (43) extends downward from the lower end of the container body (41) and is then bent toward the suction pipe (16) of the compressor body (11) so as to be connected to the suction pipe (16).

Dimensional Relation Among Various Members

A high-speed rotation of the compression mechanism (50) has been requested in order to further improve the compressor performance. If the number of revolutions of the compressor body (11) is increased, the vibrations in the direction in which the compressor body (11) inclines toward the accumulator (40) increase in proportion to the square of the number of revolutions. As a result, the vibrations in the axial direction of the accumulator (40) increase and propagate to the entire outdoor unit via the inlet pipe (42), resulting in greater noise generated by the product.

In this embodiment, the optimum dimensional relation among various members has been studied so that vibrations of the accumulator (40) can be kept from increasing even when the number of revolutions of the compressor body (11) is increased.

Figure 5:
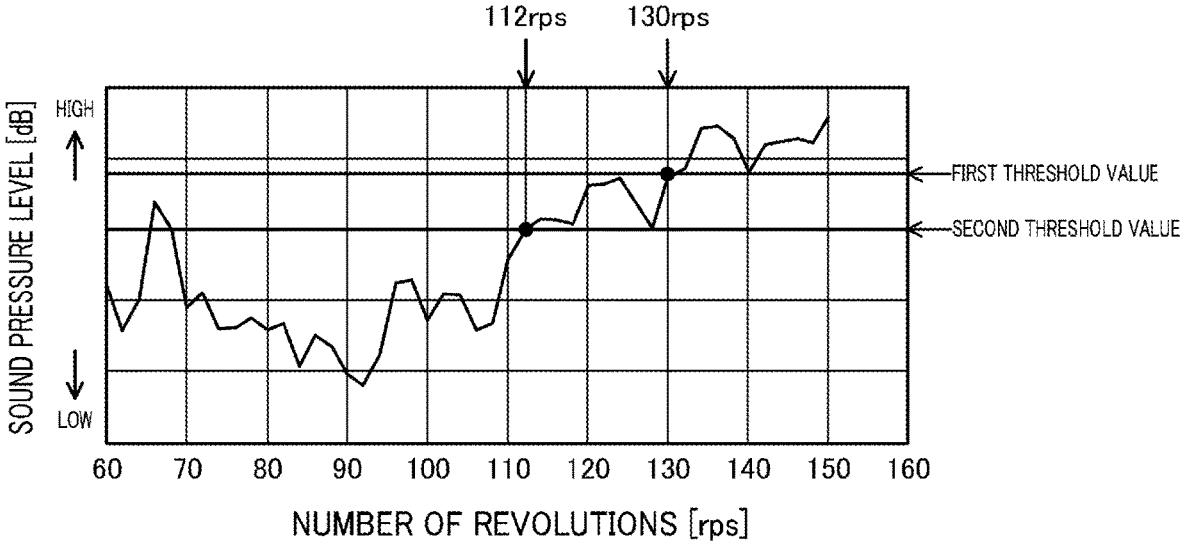
FIG. 5 is a graph showing the relation between the number of revolutions of a compressor body of a known compressor unit and the sound pressure level of product sound.

FIG. 5 is a graph showing the relation between the number of revolutions of a compressor body of a known compressor unit and the sound pressure level of product sound. As shown in FIG. 5, the sound pressure level of noise produced by the product tends to increase as the number of revolutions of the compressor body (11) increases. In a known compressor unit (10), it is determined that the sound pressure level is over a noise reference acceptable as product specifications if the sound pressure level exceeds a first threshold value. The number of revolutions of the compressor body (11) at the first threshold value is set to be 130 rps.

In addition, a second threshold value less than the first threshold value is set as a new noise reference. If the sound pressure level exceeds the second threshold value, it is determined that the sound pressure level is over a noise reference acceptable as product specifications. The number of revolutions of the compressor body (11) at the second threshold value is set to be 112 rps.

Figure 6:
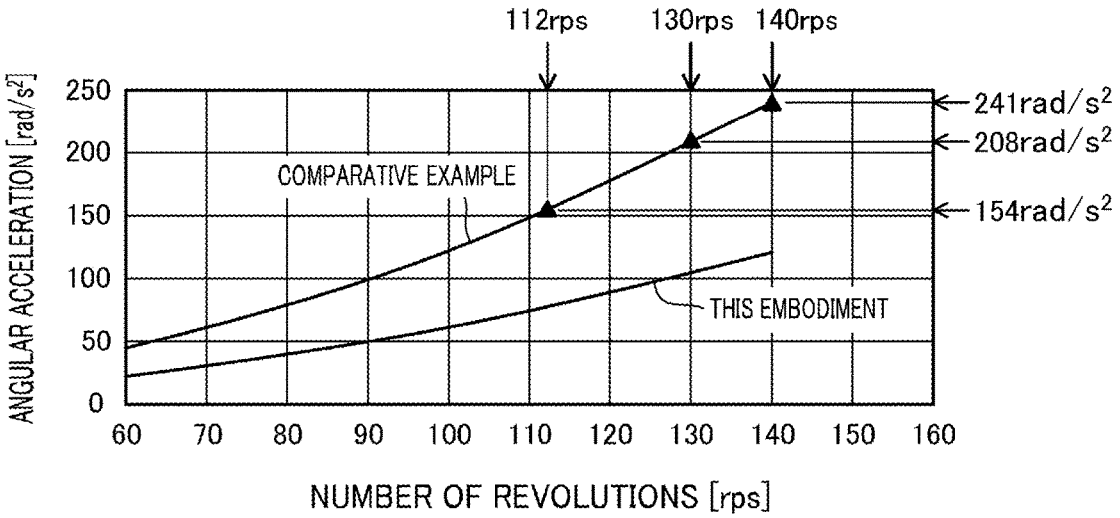
FIG. 6 is a graph showing the relation between the number of revolutions of a compressor body and the angular acceleration of rotational vibration around the Y axis of the compressor unit.

FIG. 6 is a graph showing the relation between the number of revolutions of each of compressor bodies and the angular acceleration of rotational vibration around the Y axis of the associated compressor unit. The angular acceleration as used herein indicates a value of rotational vibration around the Y axis induced by the inertial force of the piston (54) and the blade (57), where the Y axis represents the center axis of the compressor unit (10) passing through the center of gravity (G1) of the compressor unit (10), which is also the center of rotation of the compressor body (11) during vibrations in the direction in which the compressor body (11) inclines toward the accumulator (40). The inertial force of the piston (54) and the blade (57) is in proportion to a value obtained by multiplying the weight of the piston (54) and the blade (57) by the square of the number of revolutions.

As shown in FIG. 6, if the number of revolutions of a compressor body (11) of a known compressor unit of a comparative example is set to 140 rps, the angular acceleration is 241 rad/s$^2$. Here, if the number of revolutions of the compressor body (11) that has been studied as a reference of the sound pressure level is 130 rps in FIG. 5, the angular acceleration is 208 rad/s$^2$. If the number of revolutions of the compressor body (11) is 112 rps, the angular acceleration is 154 rad/s$^2$.

In the following description, the number of revolutions of the compressor body (11) that is greater than or equal to a predetermined number of revolutions is referred to as the "maximum number of revolutions." The predetermined number of revolutions is greater than or equal to 112 rps, preferably greater than or equal to 130 rps. The maximum number of revolutions of the compressor body (11) means the maximum number of revolutions that may appear in the range of operation of the product.

An object of this embodiment is to make the angular acceleration, which is the value of rotational vibration around the Y axis induced by the inertial force of the piston (54) and the blade (57), less than that of the known compressor unit.

To achieve the object, in the compressor unit (10) of this embodiment, the value of the vibration needs to be 208/241=0.86 times so that the value of rotational vibration around the Y axis induced by the inertial force of the piston (54) and the blade (57) be lowered to the value at 130 rps when the maximum number of revolutions of the compressor body (11) is 140 rps.

Further, the value of the vibration needs to be 154/241=0.64 times so that the value of rotational vibration around the Y axis induced by the inertial force of the piston (54) and the blade (57) be lowered to the value at 112 rps when the maximum number of revolutions of the compressor body (11) is 140 rps.

Figure 7:
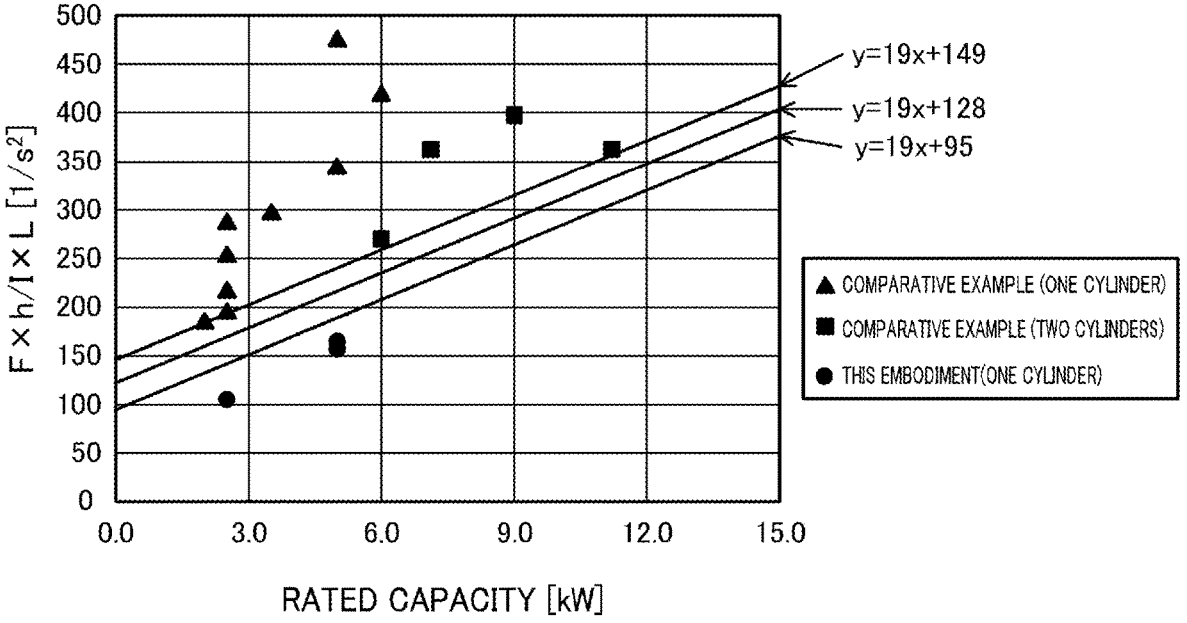
FIG. 7 is a graph showing the relation between the rated capacity of each refrigeration apparatus and the parameter $F\times(h/I)\times L$.

FIG. 7 is a graph showing the relation between the rated capacity of each refrigeration apparatus and the parameter F×(h/I)×L. In this embodiment, F×(h/I)×L is defined as a parameter indicating the magnitude of the vibrations of the accumulator (40) in the vertical direction. This parameter is set to be smaller than a value that is set based on the rated capacity P of the refrigeration apparatus (1).

Specifically, as illustrated in FIG. 2, F [kg/s$^2$] represents a value obtained by multiplying the weight of the piston (54) and the blade (57) by the square of the number of revolutions of the compressor body (11); h [m] represents the distance from the center of the piston (54) in the thickness direction to the center of gravity (G1) of the compressor unit (10); I [kg·m$^2$] represents the moment of inertia around the center axis of the compressor unit (10) passing through the center of gravity (G1) of the compressor unit (10), which is also the center of rotation of the compressor body (11) during vibrations in the direction in which the compressor body (11) inclines toward the accumulator (40); L [m] represents the distance from the axis of the inlet pipe (42) of the accumulator (40) to the center of gravity (G1) of the compressor unit (10); and P [KW] represents the rated capacity of the refrigeration apparatus (1).

As shown in the graph of FIG. 7, if the maximum number of revolutions of the compressor body (11) of the known compressor unit is increased to 140 rps, the straight line indicated by y=19x+149 is the line of the minimum value of the parameter F×(h/I)×L, where x represents the horizontal axis and y represents the vertical axis. Specifically, the parameter F×(h/I)×L calculated for each of a known one-cylinder compressor unit including one cylinder (51) and a known two-cylinder compressor unit including two cylinders (51) is located above the straight line indicated by y=19x+149.

In contrast, in the compressor unit (10) of this embodiment, the intercept of y=19x+149 calculated for the known compressor unit is set to be 0.86 times of the result calculated based on the graph of FIG. 6, that is, the intercept is offset to 128.

In this case, in the compressor unit (10) of this embodiment, the parameter F×(h/I)×L is set to satisfy the following expression (1).

$$F \times (h/I) \times L \leq 19 \times P + 128 \quad (1)$$

Satisfying the expression (1) can keep the vibrations of the accumulator (40) from increasing even when the maximum number of revolutions of the compressor body (11) is set to be greater than or equal to 130 rps.

Alternatively, in the compressor unit (10) of this embodiment, the intercept of y=19x+149 is set to be 0.64 times of the result calculated based on the graph of FIG. 6, that is, the intercept is offset to 95.

Thus, in the compressor unit (10) of this embodiment, the parameter F×(h/I)×L is set to satisfy the following expression (2).

$$F \times (h/I) \times L \leq 19 \times P + 95 \quad (2)$$

Satisfying the expression (2) can keep the vibrations of the accumulator (40) from increasing even when the maximum number of revolutions of the compressor body (11) is set to be greater than or equal to 112 rps.

Measure to Satisfy Conditional Expression

Specific measures to make the parameter F×(h/I)×L smaller than the value set based on the rated capacity P of the refrigeration apparatus (1) will be described below.

First, it is conceivable to reduce the weight of at least one of the piston (54) or the blade (57). The parameter F is proportional to the value obtained by multiplying the weight of the piston (54) and the blade (57) by the square of the number of revolutions. It is thus possible to make the parameter F smaller by reducing the weight of at least one of the piston (54) or the blade (57).

For example, in the known compressor unit, the density of the piston (54) and the blade (57) is about 7000 kg/m$^3$. Thus, in this embodiment, the density of the at least one of the piston (54) or the blade (57) is set to be equal to or less than, for example, 7000×0.86=6020 kg/m$^3$ so that the expression (1) be satisfied. Specifically, it is preferable to use aluminum as a material of the at least one of the piston (54) or the blade (57). The density of aluminum is 2700 kg/m$^3$, which satisfies the condition.

It is also conceivable to lower the position of the center of gravity (G1) of the compressor unit (10) and reduce the distance h from the center of the piston (54) in the thickness direction to the center of gravity (G1) of the compressor unit (10).

Figure 8:
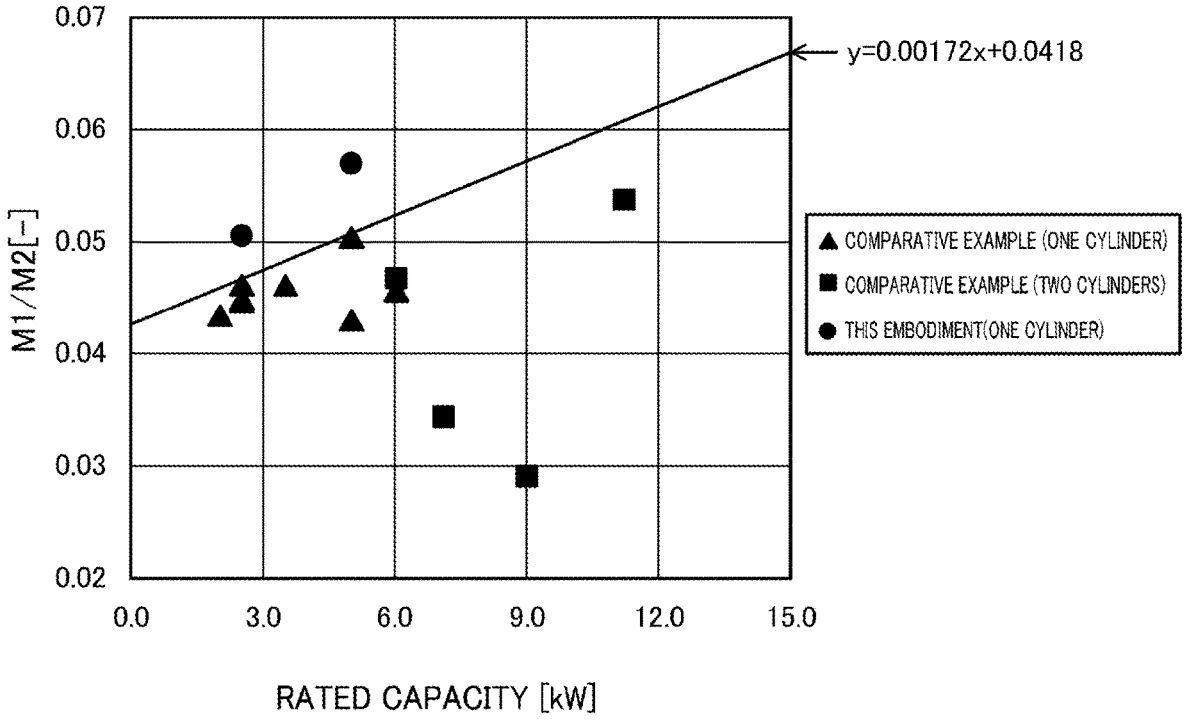
FIG. 8 is a graph showing the relation between the rated capacity of each refrigeration apparatus and the parameter M1/M2.

Specifically, FIG. 8 is a graph showing the relation between the rated capacity of each refrigeration apparatus and the parameter M1/M2. Here, M1 [kg] represents the weight of the lubricant filling the compressor body (11), and M2 [kg] represents the weight of the compressor unit (10).

As shown in the graph of FIG. 8, in the known compressor unit, the straight line indicated by y=0.0172x+0.0418 is the line of the maximum value of the parameter M1/M2, where x represents the horizontal axis and y represents the vertical axis. Specifically, the parameter M1/M2 calculated for each of a known one-cylinder compressor unit including one cylinder (51) and a known two-cylinder compressor unit including two cylinders (51) is located below the straight line indicated by y=0.0172x+0.0418.

In contrast, in the compressor unit (10) of this embodiment, the parameter M1/M2 is set to satisfy the following expression (3).

$$M1/M2 > 0.0172 \times P + 0.0418 \quad (3)$$

Satisfying the expression (3) can increase the amount of the lubricant accumulated at the bottom of the compressor body (11) and lower the position of the center of gravity (G1) of the compressor unit (10). It is therefore possible to make the value of the parameter F×(h/I)×L smaller.

It is also conceivable to devise the shape of the balance weights (30) to reduce oil loss and increase the amount of the lubricant accumulated at the bottom of the compressor body (11).

Figure 3:
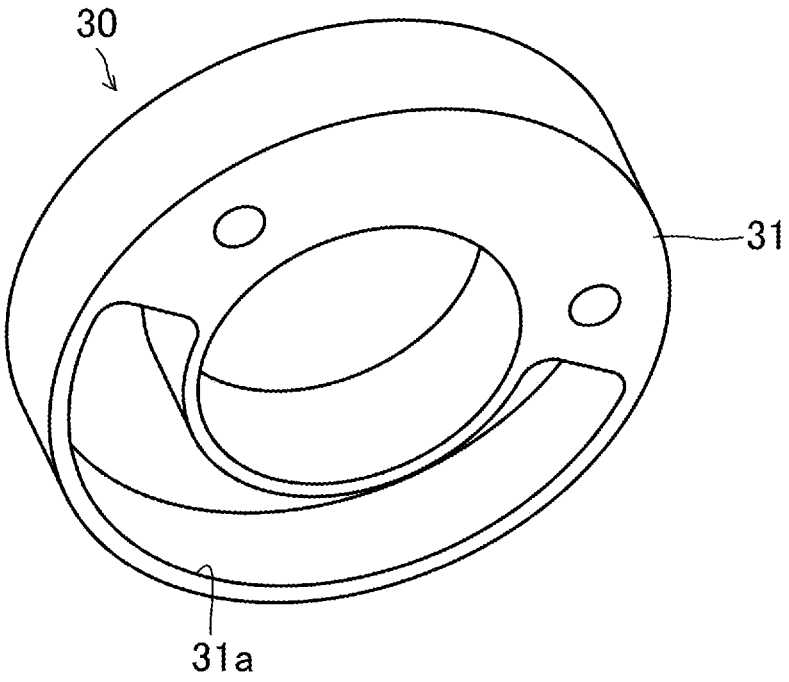
FIG. 3 is a perspective view illustrating a configuration of a balance weight.

As illustrated in FIG. 3, each of the balance weights (30) has a ring-shaped weight body (31) extending in the circumferential direction. The surface of the weight body (31) near the rotor (23) has a recess (31*a*) extending along the circumferential direction.

Each of the balance weights (30) has a ring shape extending in the circumferential direction. That is, the balance weight (30) has a shape continuous in the circumferential direction, making it difficult for the refrigerant including the lubricant to be stirred during rotation of the rotor (23).

Thus, even if the balance weights (30) rotate together with the rotor (23), the lubricant is less likely to be stirred up by the balance weights (30), thereby making it possible to reduce the oil loss. As a result, it is possible to ensure a sufficient amount of lubricant accumulated at the bottom of the compressor body (11) and lower the position of the center of gravity (G1) of the compressor unit (10).

It is also conceivable to lower the position of the center of gravity (G2) of the motor (21) and lower the position of the center of gravity (G1) of the compressor unit (10), thereby reducing the distance h from the center of the piston (54) in the thickness direction to the center of gravity (G1) of the compressor unit (10).

Figure 9:
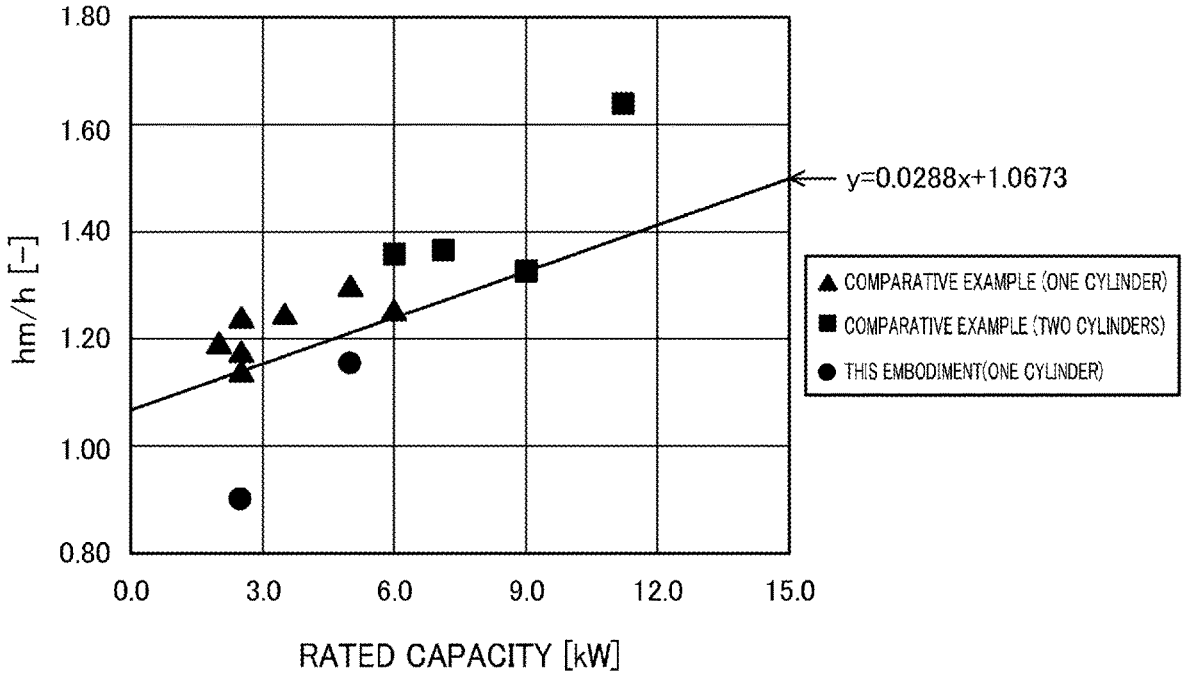
FIG. 9 is a graph showing the relation between the rated capacity of each refrigeration apparatus and the parameter hm/h.

Specifically, FIG. 9 is a graph showing the relation between the rated capacity of each refrigeration apparatus and the parameter hm/h. Here, hm [m] represents the distance from the center of the piston (54) in the thickness direction to the center of gravity (G2) of the motor (21).

As shown in the graph of FIG. 9, in the known compressor unit, the straight line indicated by y=0.0288x+1.0673 is the lie of the minimum value of the parameter hm/h, where x represents the horizontal axis and y represents the vertical axis. Specifically, the parameter hm/h calculated for each of a known one-cylinder compressor unit including one cylinder (51) and a known two-cylinder compressor unit including two cylinders (51) is located above the straight line indicated by y=0.0288x+1.0673.

In contrast, in the compressor unit (10) of this embodiment, the parameter hm/h is set to satisfy the following expression (4).

$$hm/h < 0.0288 \times P + 1.0673 \quad (4)$$

As can be seen, satisfying the expression (4) can lower the position of the center of gravity (G2) of the motor (21) and can lower the position of the center of gravity (G1) of the compressor unit (10).

Advantages of Embodiment

According to a feature of this embodiment, the condition "F×(h/I)×L≤19×P+128" is satisfied, where F represents a value obtained by multiplying the weight of the piston (54) and the blade (57) by the square of the number of revolutions of the compressor body (11); h represents the distance from the center of the piston (54) in the thickness direction to the center of gravity (G1) of the compressor unit (10); I represents the moment of inertia around the center axis of the compressor unit (10) passing through the center of gravity (G1) of the compressor unit (10), which is also the center of rotation of the compressor body (11) during vibrations in the direction in which the compressor body (11) inclines toward the accumulator (40); L represents the distance from the axis of the inlet pipe (42) of the accumulator (40) to the center of gravity (G1) of the compressor unit (10); and P represents the rated capacity of the refrigeration apparatus (1).

In this manner, F×(h/I)×L is defined as a parameter indicating the magnitude of the vibrations of the accumulator (40) in the vertical direction. This parameter is set to be smaller than a value that is set based on the rated capacity P of the refrigeration apparatus (1).

It is thus possible to keep vibrations of the accumulator (40) from increasing even when the number of revolutions of the compressor body (11) is increased.

According to a feature of this embodiment, it is possible to further keep the vibrations of the accumulator (40) from increasing by satisfying the condition "F×(h/I)×L≤19×P+95."

According to a feature of this embodiment, it is possible to improve the compressor performance and keep the vibrations of the accumulator (40) from increasing in a high rotational speed range as well, by increasing the number of revolutions of the compressor body (11) to 112 rps or more.

According to a feature of this embodiment, it is possible to further improve the compressor performance and keep the vibrations of the accumulator (40) from increasing in a high rotational speed range as well, by increasing the number of revolutions of the compressor body (11) to 130 rps or more.

According to a feature of this embodiment, it is possible to keep the vibrations of the accumulator (40) from increasing in the case of a one-cylinder compressor body (11) as well, in which a problem of vibrations is particularly significant in a high rotational speed range.

According to a feature of this embodiment, it is possible to make the parameter F smaller, and hence the value of the parameter F×(h/I)×L smaller, by setting the density of at least one of the piston (54) or the blade (57) to be 6020 $kg/m^3$ or less and reducing the weight.

According to a feature of this embodiment, it is possible to make the parameter F smaller by using aluminum as a material of at least one of the piston (54) or the blade (57) and reducing the weight.

According to a feature of this embodiment, it is possible to increase the amount of the lubricant accumulated at the bottom of the compressor body (11) and lower the position of the center of gravity (G1) of the compressor unit (10) by satisfying the condition M1/M2>0.0172×P+0.0418, where M1 represents the weight of the lubricant filling the compressor body (11) and M2 represents the weight of the compressor unit (10). It is therefore possible to make the value of the parameter F×(h/I)×L smaller.

According to a feature of this embodiment, each of the balance weights (30) has the ring-shaped weight body (31) extending in the circumferential direction at an axial end of the rotor (23). The surface of the weight body (31) near the rotor (23) has a recess (31*a*) extending along the circumferential direction.

Each of the balance weights (30) has a ring shape extending in the circumferential direction. That is, the balance weight (30) has a shape continuous in the circumferential direction, making it difficult for the refrigerant including the lubricant to be stirred during rotation of the rotor (23).

Thus, even if the balance weights (30) rotate together with the rotor (23), the lubricant is less likely to be stirred up by the balance weights (30), thereby making it possible to reduce the oil loss. As a result, it is possible to ensure a sufficient amount of lubricant accumulated at the bottom of the compressor body (11) and lower the position of the center of gravity (G1) of the compressor unit (10).

According to a feature of this embodiment, it is possible to lower the position of the center of gravity (G2) of the motor (21) and lower the position of the center of gravity (G1) of the compressor unit (10) by satisfying the condition hm/h<0.0288×P+1.0673, where hm represents the distance from the center of the piston (54) in the thickness direction to the center of gravity (G2) of the motor (21).

According to a feature of this embodiment, a refrigeration apparatus includes the compressor unit (10) and the refrigerant circuit (la) through which the refrigerant compressed by the compressor unit (10) flows. It is therefore possible to provide the refrigeration apparatus (1) including the compressor unit (10).

First Variation

In the following description, the same reference characters designate the same components as those of the foregoing embodiment, and the description is focused only on the difference.

As illustrated in FIGS. 10 and 11, each of the balance weights (30) includes a weight body (31) and a weight cover (32). The weight body (31) has an arc shape extending in the circumferential direction at an axial end of the rotor (23).

The weight cover (32) includes a cover body (32*a*), an inner peripheral wall (32*b*), and an outer peripheral wall (32*c*). The cover body (32*a*) is configured as a ring-shaped plate member. The inner peripheral wall (32*b*) stands along the inner peripheral edge of the cover body (32*a*). The outer peripheral wall (32*c*) stands along the outer peripheral edge of the cover body (32*a*). The weight body (31) is covered with the cover body (32*a*), the inner peripheral wall (32*b*), and the outer peripheral wall (32*c*) of the weight cover (32).

Advantages of First Variation

According to a feature of this variation, each of the balance weights (30) includes the weight body (31) and the weight cover (32). The weight body (31) is covered with the ring-shaped weight cover (32). That is, the balance weight (30) has a shape continuous in the circumferential direction, making it difficult for the refrigerant including the lubricant to be stirred during rotation of the rotor (23).

Thus, even if the balance weights (30) rotate together with the rotor (23), the lubricant is less likely to be stirred up by the balance weights (30), thereby making it possible to reduce the oil loss. As a result, it is possible to ensure a sufficient amount of lubricant accumulated at the bottom of the compressor body (11) and lower the position of the center of gravity (G1) of the compressor unit (10).

Second Variation

Figure 12:
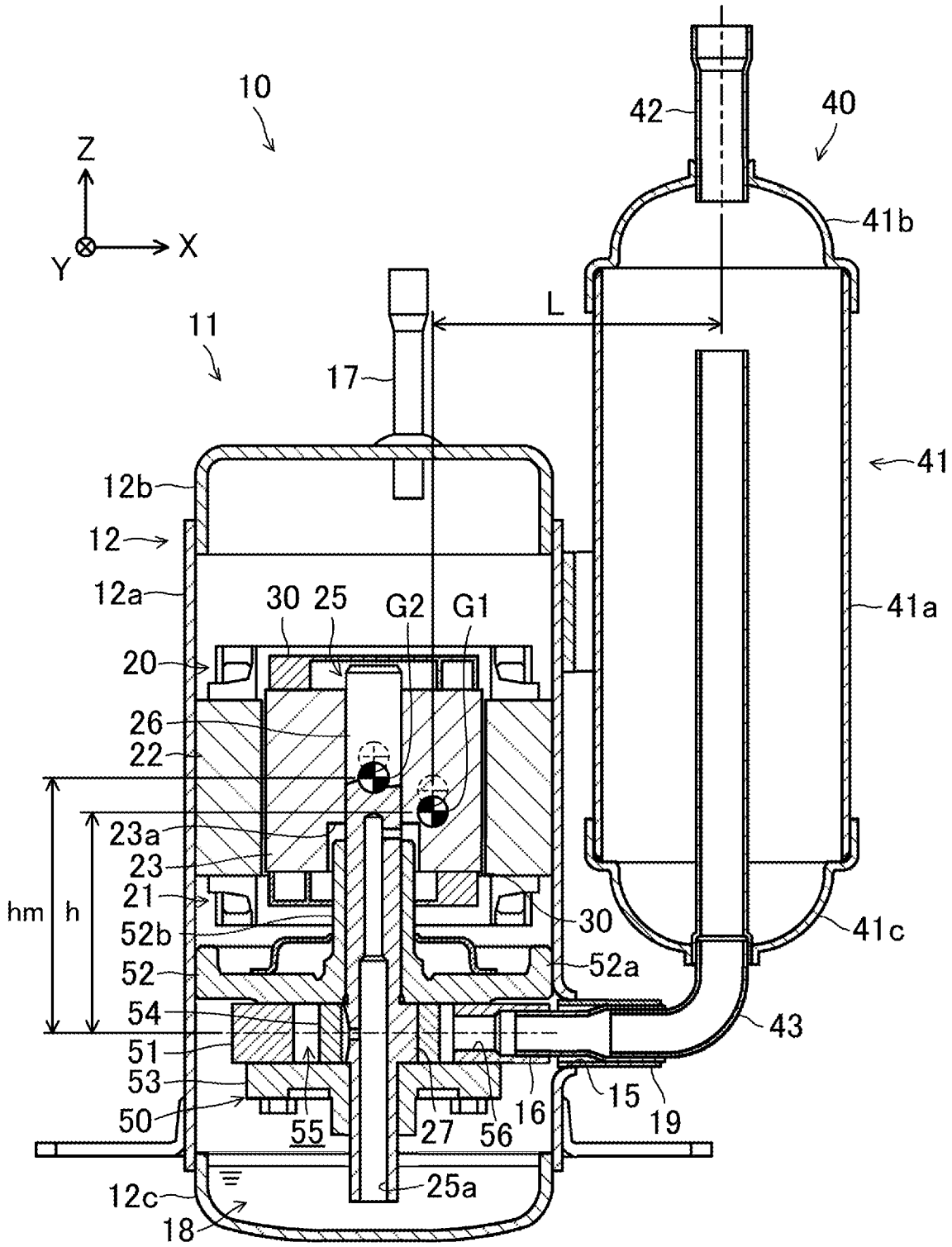
FIG. 12 is a longitudinal sectional view illustrating a configuration of a compressor unit according to a second variation.

As illustrated in FIG. 12, a compression mechanism (50) includes a front head (52) disposed below the motor (21). The front head (52) includes a boss portion (52*b*) extending upward to support a drive shaft (25).

A central portion of the lower end of the rotor (23) has a recess (23*a*). An upper end portion of the boss portion (52*b*) is inserted in the recess (23*a*) of the rotor (23). Thus, a lower end portion of the rotor (23) and the upper end portion of the boss portion (52*b*) overlap each other when viewed in the radial direction.

Advantages of Second Variation

According to a feature of this variation, it is possible to lower the position of the center of gravity (G1) of the compressor unit (10) by arranging the lower end portion of the rotor (23) and the upper end portion of the boss portion (52*b*) so as to overlap each other when viewed in the radial direction and lowering the position of the center of gravity (G2) of the motor (21).

Third Variation

Figure 13:
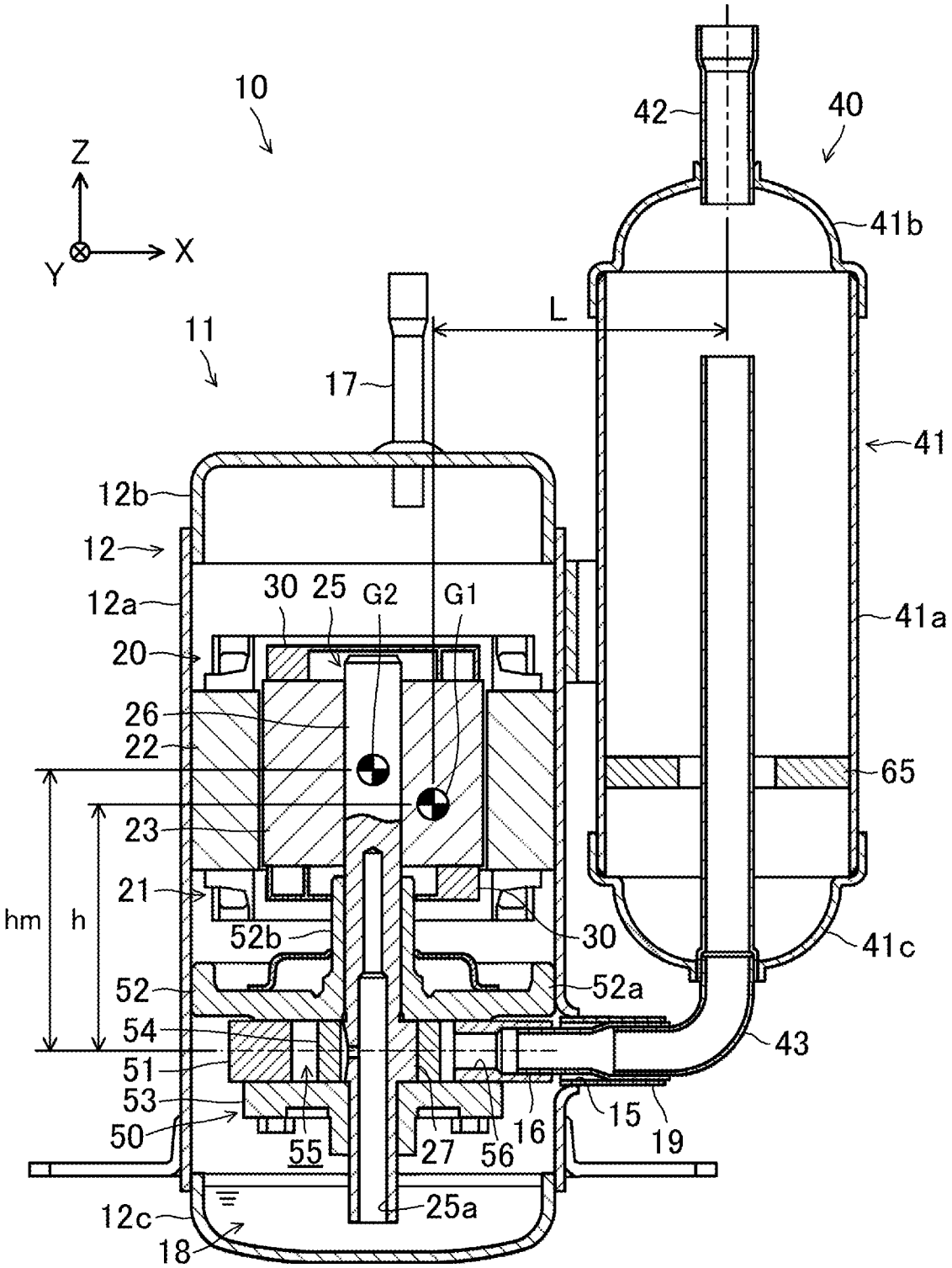
FIG. 13 is a longitudinal sectional view illustrating a configuration of a compressor unit according to a third variation.

As illustrated in FIG. 13, an accumulator (40) includes a partition plate (65). The partition plate (65) is configured as a ring-shaped plate member. An outlet pipe (43) of the accumulator (40) is inserted in a central hole of the partition plate (65). The partition plate (65) partitions the interior of the accumulator (40) into upper and lower spaces. The partition plate (65) is disposed below a middle portion in the axial direction of the accumulator (40).

Advantages of Third Variation

According to a feature of this variation, it is possible to lower the position of the center of gravity (G1) of the compressor unit (10) by arranging the partition plate (65) below a middle portion in the axial direction of the accumulator (40) and lowering the position of the center of gravity of the accumulator (40).

Fourth Variation

Figure 14:
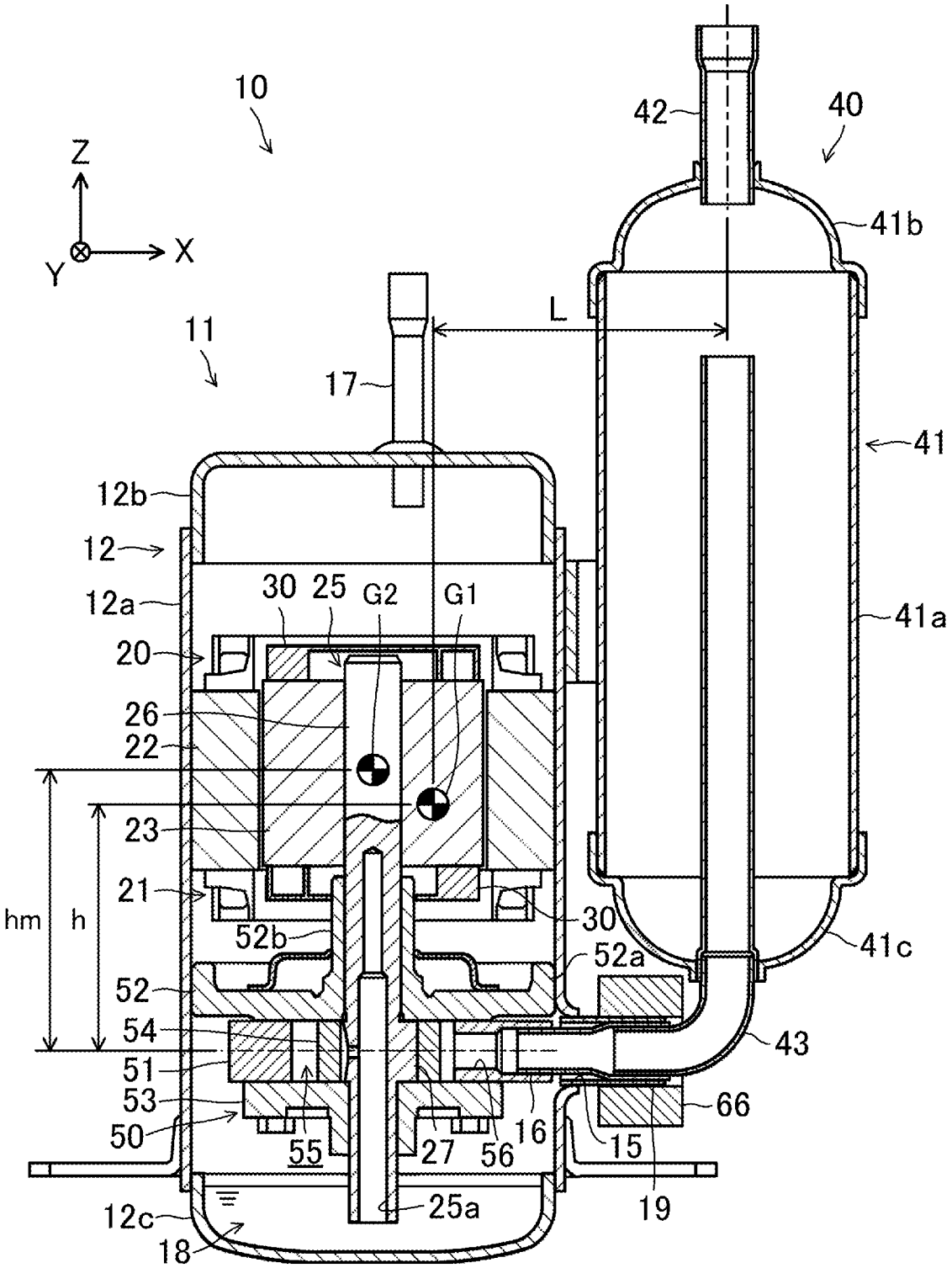
FIG. 14 is a longitudinal sectional view illustrating a configuration of a compressor unit according to a fourth variation.

As illustrated in FIG. 14, an outlet pipe (43) of an accumulator (40) is provided with a weight member (66). As can be seen, the position of the center of gravity of the accumulator (40) is lowered by the weight member (66) attached to the outlet pipe (43). It is thus possible to lower the center of gravity (G1) of the compressor unit (10).

Advantages of Fourth Variation

According to a feature of this variation, it is possible to lower the position of the center of gravity (G1) of the compressor unit (10) by providing the weight member (66) on the outlet pipe (43) of the accumulator (40) to lowers the position of the center of gravity of the accumulator (40).

Fifth Variation

Figure 15:
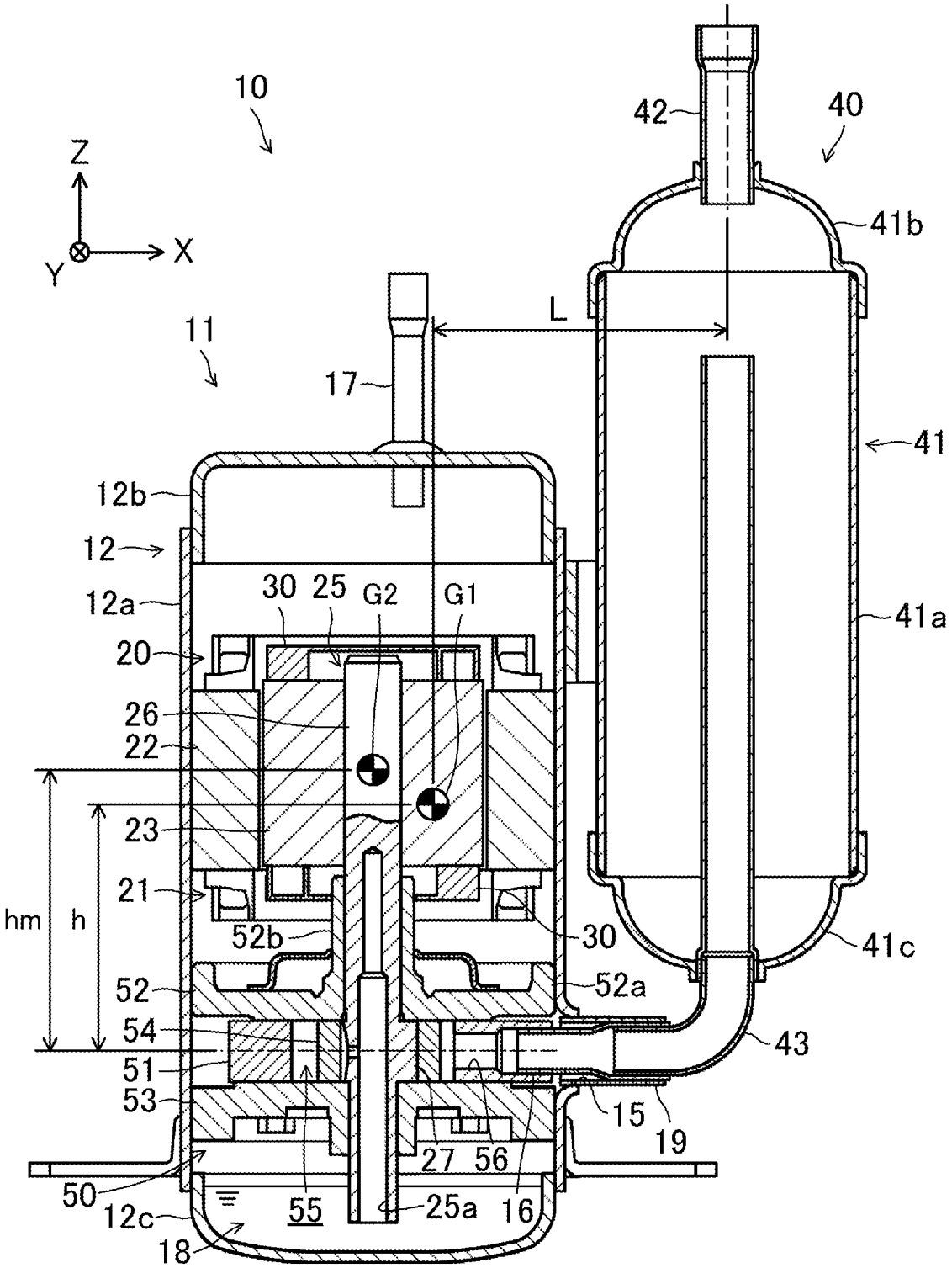
FIG. 15 is a longitudinal sectional view illustrating a configuration of a compressor unit according to a fifth variation.

As illustrated in FIG. 15, a compression mechanism (50) includes a rear head (53) disposed on a lower portion of a cylinder (51). The rear head (53) projects radially outward to be in tight contact with the inner peripheral surface of a casing (12) of a compressor body (11). The rear head (53) is fixed to the inner peripheral surface of the casing (12) of the compressor body (11).

Advantages of Fifth Variation

According to a feature of this variation, it is possible to increase the weight of the rear head (53) and lower the position of the center of gravity (G1) of the compressor unit (10) by fixing the rear head (53) to the inner peripheral surface of the casing (12) of the compressor body (11).

OTHER EMBODIMENTS

The above-described embodiments may be modified as follows.

In this embodiment, the barrel (12*a*), the upper cup (12*b*), and the lower cup (12*c*) of the casing (12) of the compressor body (11) are assumed to have the same plate thickness. However, the embodiment is not limited thereto. For example, the plate thickness of the lower cup (12*c*) may be greater than that of the upper cup (12*b*).

It is possible to lower the position of the center of gravity (G1) of the compressor unit (10) by making the lower cup (12*c*) of the casing (12) have a greater plate thickness than the upper cup (12*b*) and lowering the position of the center of gravity of the compressor body (11).

In this embodiment, the barrel (41*a*), the upper housing (41*b*), and the lower housing (41*c*) of the container body (41) of the accumulator (40) are assumed to have the same plate thickness. However, the embodiment is not limited thereto. For example, the plate thickness of the lower housing (41*c*) may be greater than that of the upper housing (41*b*).

It is possible to lower the position of the center of gravity (G1) of the compressor unit (10) by making the lower housing (41*c*) of the accumulator (40) have a greater plate thickness than the upper housing (41*b*) and lowering the position of the center of gravity of the accumulator (40).

In this embodiment, an oscillating piston compressor including the piston (54) and the blade (57) integrated together has been described. However, a rolling piston rotary compressor including the piston (54) and the blade (57) separate from each other may be used. In this case, as well, the parameter F is calculated by multiplying the weight of the piston (54) and the blade (57) by the square of the number of revolutions of the compressor body (11). In the case of a rotary compressor including the piston (54) and the blade (57) separate from each other, it is not necessary to support the blade (57) in a manner that allows oscillation of the blade (57). Bushes (58) are therefore not needed.

In this embodiment, a one-cylinder compressor including one cylinder (51) has been described. However, the conditional expression of the parameter F×(h/I)×L is applicable to a two-cylinder compressor, as well, which includes two cylinders (51) arranged side by side in the vertical direction.

Figure 16:
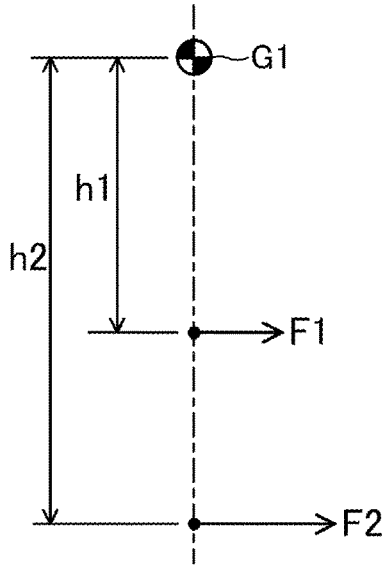
FIG. 16 is a diagram illustrating the force applied to each of pistons of a two-cylinder compressor and the distance from the piston to the center of gravity of the two-cylinder compressor according to another embodiment.

Specifically, as illustrated in FIG. 16, F1 represents a value obtained by multiplying the weight of an upper piston (54) and an upper blade (57) by the square of the number of revolutions of the compressor body (11), and F2 represents a value obtained by multiplying the weight of a lower piston (54) and a lower blade (57) by the square of the number of revolutions of the compressor body (11). The character h1 represents the distance from the center of the upper piston (54) in the thickness direction to the center of gravity (G1) of the compressor unit (10), and the character h2 represents the distance from the center of the lower piston (54) in the thickness direction to the center of gravity (G1) of the compressor unit (10).

Here, F represents the sum of F1 and F2 and is expressed as F=F1+F2. F×h represents the total moment of forces around the center of gravity and is expressed as F× h=F1× h1+F2×h2. Thus, the following expression (5) is satisfied.

$$h = h1 \times F1/(F1 + F2) + h2 \times F2/(F1 + F2) \quad (5)$$

The conditional expression of the parameter F×(h/I)×L is applicable to a compressor including three or more cylinders (51) as well.

Specifically, in the case of a compressor including n cylinders (51), each of F1, F2, F3, . . . represents a value obtained by multiplying the weight of the associated piston (54) and the associated blade (57) by the square of the number of revolutions of the compressor body (11). A value obtained by multiplying the weight of the i-th piston (54) and the i-th blade (57) by the square of the number of revolutions of the compressor body (11) will be hereinafter referred to as "Fi."

Each of the characters h1, h2, h3, . . . represents the distance from the center of the associated piston (54) in the thickness direction to the center of gravity (G1) of the compressor unit (10). The distance from the i-th piston (54) to the center of gravity (G1) will be hereinafter referred to as "hi."

Here, F represents the sum of F1, F2, F3, . . . and is expressed as F=F1+F2+F3+ . . . =ΣFi. F×h represents the total moment of forces around the center of gravity and is expressed as F× h=F1×h1+F2×h2+F3×h3+ . . . =Σ(Fi×hi). Thus, the following expression (6) is satisfied.

$$h = (1/F) \times \Sigma(Fi \times hi) \quad (6)$$

In this embodiment, the parameter F×(h/I)×L is set based on the rated capacity P [KW] of the refrigeration apparatus (1). However, this embodiment is not limited thereto. For example, the parameter F×(h/I)×L may be set based on the volume V [cc] of the cylinder (51) and the number N [rps] of revolutions of the compressor body (11) which is greater than or equal to a predetermined number of revolutions.

Figure 17:
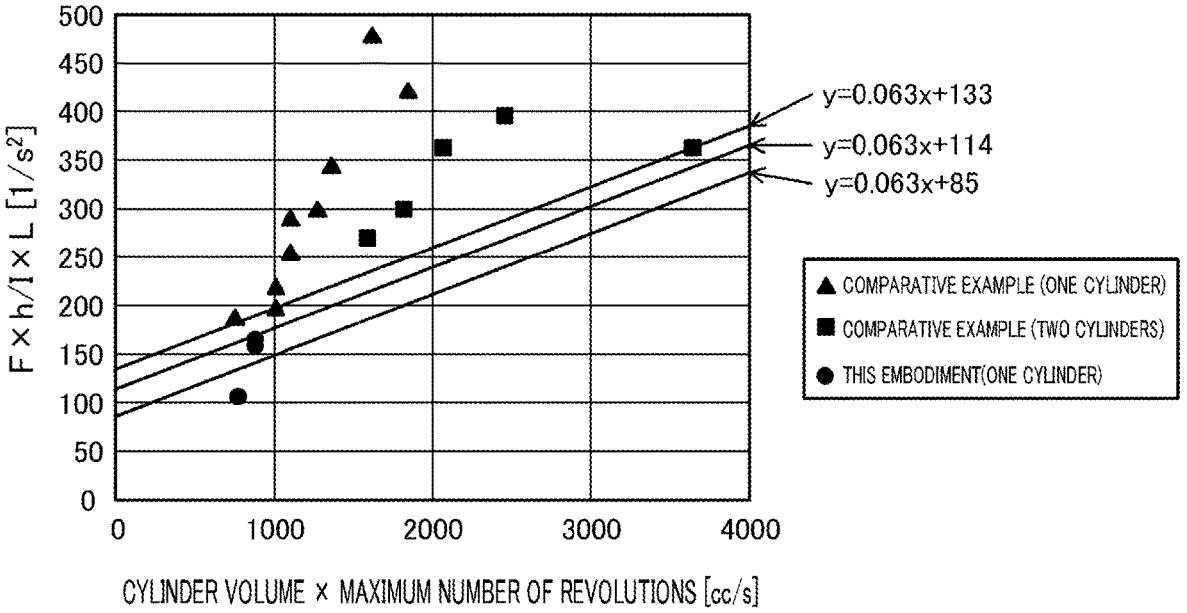
FIG. 17 is a graph showing the relation between the product $V\times N$ of the cylinder volume and the number of revolutions of each compressor body and the parameter $F\times(h/I)\times L$ according to another embodiment.

FIG. 17 is a graph showing the relation between the product V×N of the cylinder volume and the number of revolutions of a compressor body and the parameter F×(h/I)×L. In this embodiment, F×(h/I)×L is defined as a parameter indicating the magnitude of vibrations of the accumulator (40) in the vertical direction. This parameter is set to be smaller than a value set based on the product V×N of the volume V of the cylinder (51) and the number N of revolutions of the compressor body (11) which is greater than or equal to the predetermined number of revolutions.

As shown in the graph of FIG. 17, if the maximum number of revolutions of the compressor body (11) of the known compressor unit is increased to 140 rps, the straight line indicated by y=0.063x+133 is the line of the minimum value of the parameter F× (h/I)×L, where x represents the horizontal axis and y represents the vertical axis. Specifically, the parameter F×(h/I)×L calculated for each of a known one-cylinder compressor unit including one cylinder (51) and a known two-cylinder compressor unit including two cylinders (51) is located above the straight line indicated by y=0.063x+133.

In contrast, in the compressor unit (10) of this embodiment, the intercept of y=0.063x+133 calculated for the known compressor unit is set to be 0.86 times of the result calculated based on the graph of FIG. 6, that is, the intercept is offset to 114.

In this case, in the compressor unit (10) of this embodiment, the parameter F× (h/I)×L is set to satisfy the following expression (7).

$$F \times (h/I) \times L \leq 0.063 \times V \times N + 114 \quad (7)$$

Satisfying the expression (7) can keep the vibrations of the accumulator (40) from increasing even when the maximum number of revolutions of the compressor body (11) is set to be greater than or equal to 130 rps.

In the compressor unit (10) of this embodiment, the intercept of y=0.063x+133 is set to be 0.64 times of the result calculated based on the graph of FIG. 6, that is, the intercept is offset to be 85.

Thus, in the compressor unit (10) of this embodiment, the parameter F×(h/I)×L is set to satisfy the following expression (8).

$$F \times (h/I) \times L \leq 0.063 \times V \times N + 85 \quad (8)$$

Satisfying the expression (8) can keep the vibrations of the accumulator (40) from increasing even when the maximum number of revolutions of the compressor body (11) is set to be greater than or equal to 112 rps.

It will be understood that the embodiments and variations described above can be modified with various changes in form and details without departing from the spirit and scope of the claims. The embodiments and variations described above may be appropriately combined or modified by replacing the elements thereof, as long as the functions of the subject matters of the present disclosure are not impaired. In addition, the expressions of "first," "second," "third," . . . , in the specification and claims are used to distinguish the terms to which these expressions are given, and do not limit the number and order of the terms.

As can be seen from the foregoing description, the present disclosure is useful for a compressor unit and a refrigeration apparatus.

The invention claimed is:

1. A compressor unit for use in a refrigeration apparatus configured to perform a refrigeration cycle, the compressor unit comprising:

a compressor body including a compression mechanism; and an accumulator connected to the compressor body, the compression mechanism including a cylinder, a piston configured to rotate eccentrically in the cylinder, and a blade partitioning an interior of a compression chamber of the cylinder into a low-pressure chamber and a high-pressure chamber, and $$F \times (h/I) \times L \leq 19 \times P + 128$$

to suppress vibrations of the accumulator, where

F represents a value obtained by multiplying a weight of the piston and the blade by a square of a number of revolutions of a motor of the compressor body, the number of revolutions of the motor of the compressor body being greater than or equal to 112 rps, h represents a distance from a center of the piston in a thickness direction to a center of gravity of the compressor unit, I represents a moment of inertia around a center axis of the compressor unit passing through the center of gravity of the compressor unit, which is also a center of rotation of the compressor body during vibrations in a direction in which the compressor body inclines toward the accumulator, L represents a distance from an axis of an inlet pipe of the accumulator to the center of gravity of the compressor unit, and P represents a rated capacity of the refrigeration apparatus.

2. The compressor unit of claim 1, wherein $$F \times (h/I) \times L \leq 19 \times P + 95.$$

3. The compressor unit of claim 1, wherein at least one of the piston and the blade has a density equal to or lower than 6020 kg/m$^3$.

4. The compressor unit of claim 3, wherein a material of the at least one of the piston and the blade is aluminum.

5. The compressor unit of claim 1, wherein $$M1/M2 > 0.0172 \times P + 0.0418,$$

M1 represents a weight of a lubricant filling the compressor body and

M2 represent a weight of a compressor unit.

6. The compressor unit of claim 1, further comprising:

a drive mechanism configured to drive the compression mechanism, the drive mechanism including a drive shaft, the motor including a rotor configured to rotate the drive shaft, and a balance weight provided on the rotor, the balance weight including a ring-shaped weight body extending in a circumferential direction at an axial end of the rotor, and a surface of the weight body near the rotor having a recess extending along the circumferential direction.

7. The compressor unit of claim 1, further comprising:

a drive mechanism configured to drive the compression mechanism, the drive mechanism including a drive shaft, the motor including a rotor configured to rotate the drive shaft, and a balance weight provided on the rotor, the balance weight including a weight body and a weight cover, the weight body having an arc shape extending in a circumferential direction at an axial end of the rotor, the weight cover including a ring-shaped cover body, an inner peripheral wall projecting along an inner peripheral edge of the cover body, and an outer peripheral wall projecting along an outer peripheral edge of the cover body, and the weight body being covered with the cover body, the inner peripheral wall, and the outer peripheral wall of the weight cover.

8. The compressor unit of claim 1, further comprising:

a drive mechanism configured to drive the compression mechanism, the drive mechanism including a drive shaft, and the motor including a rotor configured to rotate the drive shaft, and $$hm/h < 0.0288 \times P + 1.0673,$$

where hm represents a distance from the center of the piston in the thickness direction to a center of gravity of the motor.

9. The compressor unit of claim 8, wherein the compression mechanism includes a front head disposed below the motor, the front head includes a boss portion extending upward to support the drive shaft, and a lower end portion of the rotor and an upper end portion of the boss portion overlap each other when viewed in a radial direction.

10. The compressor unit of claim 1, wherein the accumulator includes an upper housing, and a lower housing disposed below the upper housing, and the lower housing has a greater plate thickness than the upper housing.

11. The compressor unit of claim 1, wherein the accumulator includes a partition plate partitioning an interior of the accumulator into upper and lower spaces, and the partition plate is disposed below a middle portion in an axial direction of the accumulator.

12. The compressor unit of claim 1, wherein an outlet pipe of the accumulator is provided with a weight member.

13. The compressor unit of claim 1, wherein the compression mechanism includes a rear head disposed on a lower portion of the cylinder, and the rear head is fixed to an inner peripheral surface of a casing of the compressor body.

14. The compressor unit of claim 1, wherein a casing of the compressor body includes a cylindrical barrel, an upper cup configured to close an upper opening of the barrel, and a lower cup configured to close a lower opening of the barrel, and the lower cup has a greater plate thickness than the upper cup.

15. A refrigeration apparatus including the compressor unit of claim 1, the refrigeration apparatus further comprising:

a refrigerant circuit through which a refrigerant compressed by the compressor unit flows.

16. A compressor unit for use in a refrigeration apparatus configured to perform a refrigeration cycle, the compressor unit comprising:

a compressor body including a compression mechanism; and an accumulator connected to the compressor body, the compression mechanism including a cylinder, a piston configured to rotate eccentrically in the cylinder, and a blade partitioning an interior of a compression chamber of the cylinder into a low-pressure chamber and a high-pressure chamber, and $$F \times (h/I) \times L \leq 0.063 \times V \times N + 114$$

to suppress vibrations of the accumulator, where

F represents a value obtained by multiplying a weight of the piston and the blade by a square of a number of revolutions of a motor of the compressor body, h represents a distance from a center of the piston in a thickness direction to a center of gravity of the compressor unit, I represents a moment of inertia around a center axis of the compressor unit passing through the center of gravity of the compressor unit, which is also a center of rotation of the compressor body during vibrations in a direction in which the compressor body inclines toward the accumulator, L represents a distance from an axis of an inlet pipe of the accumulator to the center of gravity of the compressor unit, V represents a volume of the cylinder, and N represents the number of revolutions of the motor of the compressor body, which is greater than or equal to a predetermined number of revolutions, the predetermined number of revolutions of the compressor body being greater than or equal to 112 rps.

17. The compressor unit of claim 16, wherein $$F \times (h/I) \times L \leq 0.063 \times V \times N + 85.$$

18. The compressor unit of claim 16, wherein the predetermined number of revolutions of the compressor body is greater than or equal to 130 rps.

19. The compressor unit of claim 18, wherein the compressor body is a one-cylinder compressor body.

* * * * *